United States Patent [19]

Holik

[11] 4,116,916

[45] Sep. 26, 1978

[54] FOUNDRY RESIN COMPONENTS

[75] Inventor: Melville J. Holik, Franklin Park, Ill.

[73] Assignee: International Minerals & Chemical Corp., Libertyville, Ill.

[21] Appl. No.: 846,250

[22] Filed: Oct. 28, 1977

Related U.S. Application Data

[63] Continuation-in-part of Ser. No. 733,722, Oct. 26, 1976, abandoned, which is a continuation-in-part of Ser. No. 631,549, Nov. 13, 1975, abandoned.

[51] Int. Cl.[2] ..... C08K 5/06

[52] U.S. Cl. ..... 260/33.2 R; 252/182; 260/841; 260/38; 528/79; 528/129

[58] Field of Search ..... 252/182; 260/57 A, 60, 260/59 R, 77.5 AP, 77.5 AM, 33.2 R, 38

[56] References Cited

U.S. PATENT DOCUMENTS 3,409,579 11/1968 Robins ..... 260/59

3,676,392 7/1972 Robins ..... 260/59

3,702,316 11/1972 Robins ..... 260/38

*Primary Examiner*—Melvyn I. Marquis

*Attorney, Agent, or Firm*—Robert H. Dewey; Howard E. Post

[57] ABSTRACT

A new foundry binder composition comprises a selected phenol-formaldehyde resin, a polyisocyanate, and a selected solvent therefor. A preferred solvent is ketal or an acetal such as butyl acetal. The resole is essentially anhydrous, should contain about 8% free phenol, and is further preferably characterized by the presence of substituent $—(CH_2—O)_n—R$ groups replacing a phenolic hydrogen, R being a hydrocarbon radical such as butyl. Methylene and ether bridges linking phenolic nuclei are predominantly ortho-para with some para-para bridges. Also disclosed is the admixture of a reactive polyisocyanate and a solvent such as butyl acetal.

27 Claims, No Drawings

FOUNDRY RESIN COMPONENTS

CROSS-REFERENCE TO RELATED APPLICATIONS

This application is a continuation-in-part of Ser. No. 733,722, filed Oct. 26, 1976, now abandoned, which is a continuation-in-part of Ser. No. 631,549, filed Nov. 13, 1975, now abandoned.

BACKGROUND OF THE INVENTION

This invention relates to a core binder useful in the manufacture of foundry cores and molds. It also relates in more specific aspects to components of a core binder system.

Cores useful in making metal castings are customarily made by placing a foundry aggregate, usually silica sand which has been admixed with a suitable binder, against a shape or pattern and then hardening the binder, as by polymerization. The resulting core is a self-supporting structure which forms a part of a mold assembly.

Various sands are used for making cores. The cores themselves are made by a variety of processes employing a wide variety of binders. Three of the many processes in commercial use today are the so-called cold box process, no-bake process, and the rapid no-bake process. The cold box process is one in which sand is admixed with a suitable resinous binder composition, blown into a core box, and then gassed with a suitable vapor phase catalyst to cure the binder. By such process, which is described for example in U.S. Pat. No. 3,409,579, a core of sufficient hardness to be stripped from the core box is produced in a matter of seconds. The no-bake process is one in which a resinous core binder is admixed with a catalyst and sand and placed in a core box. The core cures at ambient temperatures but much more slowly than in the cold box process, over a period of hours or even days. After a suitable period of time, such as two hours, the core can generally be stripped from the core box, but requires further cure time. The rapid no-bake process is similar to the no-bake process, but the character of the resin and the amount and type of catalyst employed are such that a core is formed and may be stripped from the core box in a matter of a few minutes. The bench life, or time period during which a sand-resin mixture may be kept before the reaction proceeds to a detrimental extent prior to placing the mixture into the core box, generally decreases rapidly when the catalyst and resin are adjusted to provide very rapid set times. Therefore, the development of the rapid no-bake process was dependent upon the availability of foundry machines which were capable of mixing small but accurately controlled amounts of resin, catalyst and sand and transferring the admixture substantially immediately into a core box. Processes of this type are described, for example, in U.S. Pat. No. 3,702,316. The subject invention provides a binder system which is suitable for use in all three of these processes. It will be understood that the kind and amount of catalyst employed will be such as to adapt the final binder-sand admixture to the intended purpose. That is, in the cold box process, the catalyst will typically be a gaseous amine, such as triethylamine, dispersed in a suitable carrier such as carbon dioxide. In the no-bake and rapid no-bake process, amine catalysts may be employed but common metal catalysts such as lead naphthenate or dibutyl tin dilaurate are also employed in amounts adjusted to provide the desired set time.

DESCRIPTION OF THE INVENTION

Briefly, a foundry mix of this invention comprises foundry aggregate and about 1 to 5%, based upon the weight of the aggregate of a binder comprising:

(a) A phenol-formaldehyde resin characterized by:
  (1) A phenol-formaldehyde ratio in the range of about 1.0:0.75 to 1.0:2.0,
  (2) Free phenol in the amount of about 5 to 12% by weight of the resin,
  (3) Water in an amount less than about 2% by weight of the resin, and
  (4) An average of 2½ to 3½ phenolic nuclei per resin oligomer, (b) A liquid polyisocyanate reactive with the resin in the amount of about 80 to 125% by weight of the resin, and, (c) A solvent of the formula

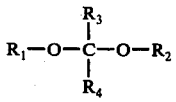

in which $R_1$ and $R_2$ are the same or different hydrocarbon radicals of three to six carbon atoms and $R_3$ and $R_4$ are the same or different hydrogen, methyl, ethyl or phenyl radicals. The solvent is present in the amount of about 10 to 40% by weight of the binder.

The binder composition is conventionally provided in two components or packages. One contains the phenolic resin, the other the isocyanate. In a preferred embodiment of the invention, both the isocyanate and the phenolic resin will be dissolved or dispersed in the selected solvent. The amount of solvent in each package may vary, provided the amount of solvent present in the resin-isocyanate mixture is within the limits specified. Further, in accordance with one embodiment of the invention, a preferred resin component or package comprises an admixture of solvent as before-defined, together with a select phenol-formaldehyde resin characterized by:

(a) A phenol-formaldehyde ratio in the range of 1.0:0.75 to 1.0:2.0,
(b) A substituent $-(CH_2\text{-}O)_y-R$ group present at about 12 to 30% of the substituted phenolic nuclear positions,
(c) Free phenol in the amount of about 5 to 15% by weight of the resin,
(d) Water in the amount of less than 2% by weight of the resin,
(e) An average of about 2½ to 3½ phenolic nuclei per resin oligomer, and
(f) A hydroxymethyl content of less than about 5 mole percent.

The phenol to phenol bridges are predominantly ortho-para, with at least 20% of the bridges being parapara, the bridges being of the formula $-CH_2(OCH_2)_x-$ where $x$ is zero in at least 30% of the bridges, and $x$ is an integer in the range of 1 to 6 in at least 20% of the bridges. The resin is characterized by substituent groups of the formula $-(CH_2-O)_y-R$ in which $y$ is an integer in the range of 1 to 6 and R is a hydrocarbon radical of three to six carbon atoms.

In a specific aspect, the invention relates to a phenol-formaldehyde resin prepared by the preferred method hereinafter described.

The phenol-formaldehyde resins employed in accordance with this aspect of the invention are preferably prepared by reacting phenol itself, i.e., non-substituted phenol, with formaldehyde or paraformaldehyde at a pH in the range of 0.6–2.5, which can be provided by the presence of an acid catalyst. The mole ratio of phenol to formaldehyde is in the range of 1.0:0.75 to 1.0:2.0. The reaction is preferably carried out under vacuum in the later stages and water is collected as the reaction proceeds. In any event, the final resin is stripped to a water content of less than 2%, and preferably less than 1%.

While phenol itself is the preferred reactant, substituted phenols may also be employed. They are not preferred, however, because they are generally more expensive and provide no advantage. Nevertheless, substituted phenols such as meta- and para-cresol may be employed as desired. Numerous other substituted phenols may also be employed as described, for example, in the aforementioned U.S. Pat. No. 3,702,316.

In the preparation of the phenol-formaldehyde resins preferred for use in this invention, either phenol itself or a phenol substituted with $—CH_2—O—R$ radicals may be employed. Phenol itself is the most preferred starting material. The reaction with formaldehyde is carried out in the presence of a suitable alcohol such as butanol, whereby the desired ether substitution takes place concomitantly with the formation of the resin. In the production of the preferred resin, phenol and formaldehyde or paraformaldehyde in amounts to provide the desired mole ratio are first charged to a kettle and a $C_3$ to $C_6$ alcohol such as butanol in the amount of 10 to 20% by weight of the total charge are then charged to the reaction kettle. The pH is adjusted to within 0.1–2.5, preferably 0.6–2.5 and is maintained in this range. This pH range can be effected by addition of an acid catalyst. Any acid catalyst which will maintain the preferred pH can be used. A preferred catalyst is hypophosphorous acid in amounts such as 0.15 and 0.45% by weight of the total charge, respectively. Also, a 50% mixture of hypophosphorous acid and aspirin can be used. Oxalic acid is another example of a suitable catalyst if used in small amounts. In any event, the pH is maintained in the range of 0.1 to 2.5. The mixture is initially heated to a temperature sufficient to dissolve the paraformaldehyde (230° F.), and the reaction is then carried out at a temperature of about 215° F. to an initial endpoint at which the remaining free formaldehyde is reduced to 10 to 16% by weight of the total charge. The charge is cooled to 180° F. and the pH is adjusted to a level of 5 to 6.5. This may be achieved by adding a base such as barium hydroxide, preferably calcium hydroxide, added incrementally, or zinc oxide. Barium hydroxide octahydrate in the amount of about 1% of the phenol is also suitable for adjusting the pH. Other bases suitable for raising the pH include lithium, sodium or potassium hydroxides. The reaction proceeds with an exotherm to 195° F. The temperature is brought to 220° F. and the reaction is terminated at a free formaldehyde content of about 1.5–9%, preferably 5–6.5%. An additional quantity of butanol (preferably about twice the amount initially charged) is now added, and the reaction is continued with concomitant removal of water under vacuum to 180°–200° F. Then dehydration continues at atmospheric pressure by azeotropic distillation. Water is removed as formed in the ensuing etherification reactions to 265° F. and is reduced to a content of less than 2% by weight of the resin. Finally, almost all of the unreacted butanol is also removed during a terminal vacuum distillation. The free formaldehyde content is reduced to about 1–3% or less in the resulting product.

It should be appreciated that the character of the substituted $—CH_2—O—R$ radical will be determined by the specific alcohol employed as a reaction medium and reactant. N-butyl alcohol is preferred. However, other $C_3$ to $C_6$ alcohols such as n-propyl alcohol, isopropyl alcohol, isobutyl alcohol, sec-butyl alcohol, n-amyl alcohol, n-hexyl alcohol, and cyclohexanol may be employed. The resins produced by the aforementioned process are characterized by the presence of about 5 to 15% by weight free phenol and by the presence of bridging groups between phenol nuclei of the formula $—CH_2(OCH_2)_x—$ in which $x$ is an integer in the range of 0 to 6 with 0 predominating. Nevertheless, superior properties are imparted to the resin by the presence of bridging groups characterized by $x$ being zero in at least 30% of the bridges, and $x$ being an integer in the range of 1 to 6 in at least 20% of the bridges. It has been found that the character of the bridges, together with the aforedescribed alkoxymethylene substituent group, and the free phenol content of 5 to 15% provides a resin of outstanding properties when used in conjunction with the hereinafter defined solvent or dispersant for the resin.

The polyisocyanates which can be used in accordance with this invention are those known to be useful in the preparation of foundry core binders. Such polyisocyanates, which will hereinafter be called reactive polyisocyanates, include the aliphatic polyisocyanates such as hexamethylene diisocyanate, alicyclic polyisocyanates such as 4,4'-dicyclohexylmethane diisocyanate and aromatic polyisocyanates such as 3,4- and 2,6-toluene diisocyanate, diphenylmethyl diisocyanate, and the dimethyl derivatives thereof. Other suitable polyisocyanates are 1,5-naphthalene diisocyanate, triphenylmethane triisocyanate, xylylene diisocyanate, and the methyl derivatives thereof, polymethylenepolyphenol isocyanates and chlorophenylene-2,4-diisocyanate. Preferred, however, is the use of commercially available compositions which contain diphenylmethane diisocyanate and triphenylmethane triisocyanate.

The selected solvents used in accordance with the invention are compounds of the formula

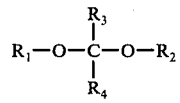

in which $R_1$ and $R_2$ are the same or different hydrocarbon radicals of three to six carbon atoms and $R_3$ and $R_4$ are the same or different methyl, ethyl, phenyl or hydrogen radicals. Preferred are compounds in which $R_3$ and $R_4$ are hydrogen. Especially preferred is dibutoxymethane. Useful solvents are dipropoxymethane, diisobutoxymethane, dipentyloxymethane, dihexyloxymethane and dicyclohexyloxymethane. Other solvents which may be used include n-butoxyisopropoxymethane, isobutoxybutoxymethane and isopropoxypentyloxymethane. Among the useful solvents in which $R_3$ and $R_4$ other than hydrogen are acetaldehyde n-propyl acetal, benzaldehyde n-butyl acetal, acetaldehyde n-butyl acetal, acetone di-n-butyl ketal and acetophenone dipropyl ketal.

The aforedescribed materials while characterized as solvents are, at least in some cases, not strictly speaking solvent to the pure resin. Nevertheless, in the presence of the specified free phenol, the selected solvents act as such, or possibly as a dispersant which is not precisely a true solvent; but in any event serve to reduce the viscosity of the resin to a suitable level such as 250 centipoises. It is thought that during the transformation of the resin to the polymeric binder, the presence of the dispersant contributes properties of adhesion to the substrata silica or refractory materials which promote the aforementioned outstanding properties. Both the phenol-formaldehyde resin and the polyisocyanate are preferably admixed with the same selected solvent. In the preferred practice of this invention, the solvent comprises about 23% by weight of the resin solvent admixture, and about 23% by weight of the polyisocyanate solvent admixture. Nevertheless, the amount of solvent in both or either of the resin component or polyisocyanate component may be varied to provide on admixture a binder which includes resin, polyisocyanate and selected solvent in the amount of 10 to 40% and preferably about 23% by weight of the binder admixture. The polyisocyanate is employed in the amount of about 80 to 125% by weight of the resin. Preferably, the resin and polyisocyanate are employed in equal amounts by weight.

In another embodiment of the instant invention, a polyisocyanate component is provided which is specially adapted for admixture with a resin component as hereinbefore described, or other resin components as will be illustrated hereafter, together with a suitable catalyst to provide a foundry core binder of outstanding properties. The polyisocyanate component comprises a reactive polyisocyanate as hereinbefore described in admixture with 10 to 40%, and preferably about 23% based upon the weight of the admixture, of a selected solvent of the formula

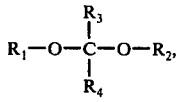

and $R_1$ and $R_2$ being the same or different hydrocarbon radicals of three to six carbon atoms, $R_3$ and $R_4$ being hydrogen, methyl, ethyl or phenyl radicals, all as hereinbefore described.

This preferred polyisocyanate component is useful in combination with the preferred phenol-formaldehyde resin component hereinbefore described but is also useful with many other conventional phenol-formaldehyde resins which are characterized generally as of the resole type but which may contain quantities of water in excess of 2% of the resin, and in fact as much as 25% by weight of the resin. Other resins, not of the phenolic type but which react with polyisocyanates to provide binders, can also be used. In such cases, the resin component may include a diluent or solvent different from the selected solvent. The solvent chosen for use in the resin component will, of course, be one which is compatible with the resin to provide stable compositions. Typical suitable solvents are cyclohexanone, isophorone, 2-(2-butoxyethoxy)ethyl acetate, alkylated naphthalene and other high solvency aromatics.

In the preparation of cores suitable for foundry use, the binder (which comprises the resin, polyisocyanate, solvent and sometimes a catalyst) is employed in an amount in the range of 1 to 5% by weight of the foundry sand. The binder and sand are mixed in a muller or other device suitable for evenly distributing the binder on the sand in keeping with the requirements of the specific processes by which the cores are made. These processes are conventional and form no part of the instant invention. As before described, a catalyst is generally employed and its selection will depend upon the specific process by which the core is made. In the cold box process, the catalyst is generally an amine such as triethylamine, the sand is coated with binder in the absence of catalyst and placed in a core box. The amine catalyst is vaporized into a gaseous substance such as carbon dioxide and blown through the core box to catalyze the reaction of the binder. In a foundry process such as the no-bake process or rapid no-bake process, either liquid amine catalysts or metal catalysts may be employed, separately or in admixture with the resin. Metal catalysts such as lead naphthenate or dibutyl tin dilaurate are preferred.

Generally such catalysts are used in amounts from 0.0001 to 0.04 by weight of the resin. The catalysis of various resin polyisocyanate binder systems in the foundry art is well known. The amount and type of catalyst is adapted to provide the desired speed of reaction in accordance with the parameters of the specific process in which the binder is employed.

The invention will be better understood with reference to the following examples. It is understood, however, that the examples are intended only to illustrate the invention and it is not intended that the invention be limited thereby.

EXAMPLE 1

As a specific example of the method of producing preferred resins of this invention, a pilot kettle was charged as follows:

| | | |
|---|---|---|
| USP Phenol | 25 lbs | 0.2660 lb mols |
| n-Butanol | 6 lbs 10 oz | 0.0895 lb mols |
| 50% Hypophosphorous Acid | 35 grams | |
| Paraformaldehyde (91%) | 13 lbs 3 oz | 0.4000 lb mols |
| Aspirin USP Powder | 8 oz | (226 grams) |

The batch was then heated to 235° F. to dissolve the paraformaldehyde within an hour, and the temperature was then dropped to 215° F. and maintained to a free formaldehyde assay of 11.9% (16 hours). The temperature was reduced to 170° F. and barium hydroxide (8 ounces) was added. An exotherm to 196° F. occurred and heating was resumed to 220° F. In 5½ hours, the free formaldehyde content dropped to 4.8% and 13 pounds of n-butanol were added, dropping the temperature to 185° F. Water began to collect from the azeotrope boiling at 200° F. under 14 inches of vacuum and 977 grams were collected in 3½ hours. The vacuum was discontinued and removal of water by azeotropic atmospheric distillation was continued until a free water content of less than 1% was reached as the end point (9.5 hours) at 265° F.

The dehydrated resin was now subjected to vacuum distillation to remove excess butanol and phenol, carried out at 25 inches of vacuum from 200° F. to 255° F. in 4½ hours. The viscosity of the amber liquid was 19,000 cps, the hydroxyl number was 344 mg KOH/- gram resin, and the 38 pounds 4.5 ounces of product was equivalent to 153% resin recovery on the phenol basis. The resin was thinned with 7 pounds of butylal to discharge the batch completely from the kettle and further reduced to 77% in butylal by the addition of 4 pounds 5 ounces supplemental butylal to obtain the desired viscosity. Specific gravity of the formulation was 1.050. The overall reaction time and preparation totaled 37 hours.

EXAMPLE 2

As an example of the use of resins of this invention in the so-called cold box process, the resin of Example 1, which made up as described to 77% resin and 23% butylal, was used in the manufacture of foundry cores specimens. The isocyanate used was a commercially available isocyanate designated Mondur MR which is a mixture of polyisocyanates. In preparing the sand-binder mixture, sand was charged to a muller. To the muller was then added the resin solution. The resin-sand mixture was mulled for 1½ minutes. The polyisocyanate, which was made up as a solution containing 77% polyisocyanate and 23% butylal, was then added and mulling continued for another 1½ minutes. The resin solution and the polyisocyanate solution were both added in the amount of 0.87% by weight of the sand. The binder-coated sand was then blown into a core box at a blow pressure of 80 psi and gassed with 12% dimethylethylamine in carbon dioxide at 35 psi for the time indicated. The core box was then purged by blowing with air for the time indicated. The trials designated "control" used a commercial resin-polyisocyanate system. The results of the trials are set forth in Table 1.

TABLE I

| Test | Gassing Cure Time Sec. | Air Purge Time Sec. | Tensile Strength, lbs/sq. in. Time After Draw 15 Min. | 30 Min. | 60 Min. | 2 Hr. | 3.5 Hr. |
|---|---|---|---|---|---|---|---|
| Control | 6 | 10 | 160 | 157.5 | 157.5 | — | — |
| | | | 157.5 | 166.3 | 165 | — | — |
| | | | 162.5 | 156.3 | 156.3 | — | — |
| Control | 3 | 6 | 145 | 155 | — | — | — |
| | | | 152.5 | 145 | — | — | — |
| | | | 151.3 | 147.5 | — | — | — |
| 1 | 6 | 10 | 135 | 157.5 | 172.5 | 207.5 | 227.5 |
| | | | 157.5 | 145 | 173.7 | 210 | 256.3 |
| | | | 153.5 | 170 | 177.5 | 212.5 | 235 |
| 2 | 3 | 6 | 186.3 | 195 | 226.3 | — | — |
| | | | 190 | 195 | 210 | — | — |
| | | | 191.3 | 191.3 | 230 | — | — |
| 3 | 1.5 | 3 | 180 | — | — | — | — |
| | | | 175 | — | — | — | — |
| | | | 162.3 | — | — | — | — |
| 4 | 1 | 6 | 165 | — | — | — | — |
| | | | 182.5 | — | — | — | — |
| | | | 180 | — | — | — | — |
| 5 | 0.5 | 1.0 | 172.5 | — | — | — | — |
| | | | 167.5 | — | — | — | — |
| | | | 177.5 | — | — | — | — |

EXAMPLE 3

As another example of the use of the binder system of this invention for the manufacture of foundry cores, the resin of Example 1 was again made up as a solution containing 77% resin and 23% butylal.

The same polyisocyanate solution used in Example 2 was employed but both the resin component and polyisocyanate component were used in the amount of 1% each, based on the weight of the Portage 430 sand employed. Sand, resin, isocyanate and catalyst were mixed in a high-speed mixing apparatus and transferred into a core box adapted to produce test specimens. The catalyst (lead naphthenate) was employed in the percentage indicated, based upon the weight of the binder. The core specimen was removed from the core box after the specified set time and its hardness was determined. In some cases, two specimens were made and the hardness of each was measured. The results of the test are set forth in Table 2.

TABLE 2

| Test | Rapid No-Bake Resin Evaluation Catalyst | Sand Temp | Set Time | Hardness (Dietert 674) |
|---|---|---|---|---|
| 1 | 2.5% | 70° F | | |
| 2 | 4.5% | 70° F | 3½ min | 69, 70 |
| 3 | 4.5% | 70° F | 2½ min | 45,80 |
| 4 | 4.5% | 94° F | 1½ min | 68 |
| 5 | 4.5% | 94° F | 1 min | 65 |
| 6 | 2.5% | 76° F | 1½ min | 56 |
| 7 | 2.5% | 76° F | 2 min | 54 |
| 8 | 3% | 76° F | 1 min | 35, 50 |
| 9 | 3.5% | 76° F | 55 sec | 20, 67 |

EXAMPLE 4

This example illustrates the use of the preferred polyisocyanate component of this invention together with a high water content phenol-formaldehyde resin. The resin is a resole prepared from 1 mole of phenol and 1.3 moles of paraformaldehyde (100% basis). The paraformaldehyde was standard 91% formaldehyde content. The reaction proceeded at 75°–85° C. in the presence of sodium hydroxide catalyst. The resin was cooled and neutralized with acetic acid to pH 6.5. The resin had a viscosity of 350 centipoises, a free phenol content of 13.6% and a water content of 16.7%. A silane was added in the amount of 0.25%. The resin was made up as 65.6% resin in isophorone and designated resin component No. 1 and as 65.6% resin in 2-(2-butoxyethoxy)-ethyl acetate and designated resin component No. 2.

The resin components were employed with polyisocyanate components in a no-bake process using Portage 430 sand, 1% resin component and 1% polyisocyanate component (based on sand weight) and 3% Kemamine catalyst (based on resin weight). Kemamine is dimethyl alkylamine wherein the alkyl group is supplied by soya oil. The results were as shown in Table 3.

TABLE 3

| Test | Resin Formulation | Isocyanate Component | Sand Temp ° F | Draw Time Min. | Hardness (Dietert) | 1 Hr Tensile Strength psi |
|---|---|---|---|---|---|---|
| 1 | Resin Component #1 | 65.6% Mondur MR in Butylal | 72 | 3 | 62 | 72, 57 |
| 2 | Resin Component #1 | 65.6% Mondur MR in Butylal | 72 | 3 | 62 | 55, 63 |
| 3 | Resin Component #1 | 65.6% Mondur MR in Butylal | 67 | 1.25 | 76 | 70, 55, 65 |
| 4 | Resin Component #1 | 65.6% Mondur MR in Butylal | 66 | 2.5 | 70 | 83, 49, 57 |
| 5 | Resin Component #1 | 65.6% Mondur MR in Aromatic Solvent | 68 | 2.75 | 79 | 20, 18, 33 |

TABLE 3-continued

| Test | Resin Formulation | Isocyanate Component | Sand Temp ° F | Draw Time Min. | Hardness (Dietert) | 1 Hr Tensile Strength psi |
|---|---|---|---|---|---|---|
| 6 | Resin Component #1 | 65.6% Mondur MR in Aromatic Solvent | 68 | 2.5 | Collapsed Specimen | 27, 17, 27 |
| 7 | Resin Component #1 | 65.6% Mondur MR in Aromatic Solvent | 64 | 2.0 | 90 | 27, 27, 27 |
| 8 | Resin Component #1 | 65.6% Mondur MR in Aromatic Solvent | 65 | 4.0 | 72 | 30, 30, 45 |
| 9 | Resin Component #2 | 65.6% Mondur MR in Butylal | 63 | 4.0 | | 83, 65, 65 |
| 10 | Resin Component #2 | 65.6% Mondur MR in Butylal | 64 | 3.5 | | 50, 55, 57 |
| 11 | Resin Component #2 | 65.6% Mondur MR in Aromatic Solvent | 63 | 4.0 | | 30, 30, 45 |

EXAMPLE 4

The polyisocyanate component of this invention was used with a resin component prepared from:

TABLE 4

| | |
|---|---|
| Bisphenol A | 4.1 g |
| Tetraethylene glycol | 2.2 g |
| Isophorone | 5.5 g |

in a cold box system, the test core being gassed with triethylamine vapor. The binder (isocyanate component and resin component) was applied to 1200 g of Portage sand in a muller.

TABLE 5

| Test | Polyisocyanate Component | Strip Tensile Strength |
|---|---|---|
| 1 | 10 g Mondur MR + 2 g Isophorone | 99, 94, 102 |
| 2 | 9.2 g Mondur MR + 4.8 g Butylal | 183, 237, 190 |

The advantage of the polyisocyanate component of this invention is evident.

EXAMPLE 5

In this example a number of acetals were evaluated in a cold box process in which 0.87% by weight of the resin component of Example 1 (77% by weight in the designated acetal) and 0.87% by weight of the polyisocyanate component were applied to Portage 430 sand and gassed with triethylamine. The polyisocyanate components each comprised 77% Mondur MR polyisocyanate, the balance being the designated acetal. The results are shown in Table 6.

TABLE 6

| Acetal (Formal) | Resin Dispersed Adequately | Isocyanate Solubility | Tensiles (psi) Green Strength | One Hour | Overnight |
|---|---|---|---|---|---|
| 1) Isobutylal | Yes | Yes | 195 | 205 | 225 |
| | | | 200 | 220 | 250 |
| | | | 210 | 230 | 270 |
| 2) Normal Butylal | Yes | Yes | 165 | 180 | 210 |
| | | | 180 | 195 | 225 |
| | | | 220 | 210 | — |
| 3) Amylal | Yes | Yes | 130 | 165 | 180 |
| | | | 135 | 175 | 215 |
| | | | 165 | — | — |
| 4) Hexylal | Yes | Yes | 110 | 120 | 160 |
| | | | 115 | 130 | 180 |
| | | | 130 | — | — |
| 5) Cyclohexylal | Yes | Yes | 120 | 170 | 160 |
| | | | 135 | 220 | 250 |
| | | | 155 | 200 | — |
| 6) Octylal | No | No | — | — | — |
| 7) Acetaldehyde n-Propyl Acetal | Yes | Yes | 189 | 146 | 108 |
| 8) Benzaldehyde n-Butyl Acetal | Yes | Yes | 143 | 167 | 224 |
| 9) Acetaldehyde n-Butyl Acetal | Yes | Yes | 126 | 149 | 195 |
| 10) Acetaldehyde Diethyl Acetal | Yes | Yes | 108 | 98 | 97 |
| 11) Acetone Di-N-butyl Ketal | Yes | Yes | 106 | 88 | 140 |
| 12) Acetone Dimethyl Ketal | Yes | Yes | 27 | — | — |
| 13) Acetophenone Dipropyl Ketal | Yes | Yes | 178 | 184 | 209 |
| 14) Isophorone | Yes | Yes | 101 | 104 | 84 |

EXAMPLE 6

The experiment of Example 1 was repeated in al essential details except that aspirin was omitted anc calcium hydroxide, added incrementally, was substi tuted for barium hydroxide. When the free formalde hyde content was reduced to 12.6%, the calcium hy droxide was added in five increments, slurried in a littl butanol, at 15 minute intervals. The first four incre ments were of 7 g each and the final one was of 9 g. Th final increment of butanol (17 lb) was added when th free formaldehyde had dropped to 5%.

The following formulation was used:

| Material | Weight | Pound-Moles |
|---|---|---|
| USP Phenol | 30 lb | 0.31915 |
| n-Butanol | 8 lb | 0.1111 |
| Hypophosphorous acid, 50% | 42 g | — |
| Paraformaldehyde (91%) | 15 lb 12 oz | 0.47775 |
| Calcium hydroxide | 37 g | — |
| n-Butanol | 17 lb | 0.2361 |

EXAMPLE 7

The experiment of Example 6 was repeated in al essential details except that sodium hydroxide, 50% aqueous, was substituted in two increments for calciun hydroxide.

The following formulation was used:

| Material | Weight, g |
|---|---|
| USP Phenol | 188 |
| n-Butanol | 50 |
| Hypophosphorous acid (50%) | 0.6 |
| Paraformaldehyde, 91% | 99 |
| Sodium hydroxide (50%) | 0.8 |
| n-Butanol | 100 |

When the free formaldehyde content reached 13.30%, 0.57 g of sodium hydroxide was added. After 25 minutes of heating the remaining sodium hydroxide (0.23 g) was added.

The resin was used to make a foundry core specimen as described in Example 2. When mixed with the polyisocyanate, it reacted rapidly.

EXAMPLE 8

The experiment of Example 7 was repeated in all essential details except that potassium hydroxide, 50% aqueous solution, 1.25 g, was substituted for the sodium hydroxide. It was added in three increments of 0.42 g, 0.40 g and 0.43 g, respectively. The second increment was added 6 minutes after the first and the third increment was added 8 minutes after the second.

The resulting product was used to make a foundry core specimen as described in Example 2. It reacted rapidly when mixed with the polyisocyanate.

EXAMPLE 9

The experiment of Example 7 was repeated in all essential details except that lithium hydroxide, 15% aqueous solution, 2.7 g, was substituted for the sodium hydroxide. It was added in increments of 0.7 g, 1.0 g and 1.0 g, respectively. The second increment was added 100 minutes after the first and the third increment was added 20 minutes after the second.

The resulting product was used to make a foundry core specimen as described in Example 2. It reacted rapidly when mixed with the polyisocyanate.

EXAMPLE 10

USP Phenol 33 lb (0.351 lb-mols) and n-butanol 8 lb 13 oz were charged into a reaction kettle. The mixture was heated to 150° F. and hypophosphorous acid 46 g, as a 50% aqueous solution, was added. Paraformaldehyde (91%) 17 lb 5 oz (0.525 lb-moles) was then added and the mixture was heated to 235° F. When the paraformaldehyde had dissolved, the reaction was continued until the free formaldehyde content was about 12%. This required about 3½ hours. At this point, a portion was withdrawn for use in Example 11 below.

Potassium hydroxide, 3.25 oz (92 g), as a 50% aqueous solution was added in two increments of 1.06 oz (30 g) each and two increments of 0.565 oz (16 g) each at 15 minute intervals. The reaction was continued at 235° F. for about an hour until the free formaldehyde content had dropped to 5%. n-Butanol 17 lb was then added to quench the reaction and water was removed by azeotropic distillation until the temperature reached 233° F. The pressure was reduced to 25 in. Hg and the distillation was continued to 232° F. to strip the remaining water and butanol. A liquid resin was obtained.

EXAMPLE 11

In Example 10, a portion of partially reacted resin mixture was withdrawn. Of this portion, 337 g (11.9 oz) was charged into a reaction vessel, heated to 235° F. and calcium hydroxide powder was added in 0.1 g increments at 15 minute intervals until about 0.5–0.53 g had been added. The reaction was continued for about 1.5 hours, at which time the free formaldehyde content was 1.7%. n-Butanol, 100 g, was added and water and solvent were removed as described in Example 10. A liquid resin product, 312 g, was obtained.

EXAMPLE 12

A seven-gallon stainless steel reaction kettle was charged with phenol 30 lb (0.319 lb moles), and n-butanol 8 lb (0.1111 lb moles). The mixture was heated to 150° F. and the pH was adjusted by adding hypophosphorous acid, 42 g, and paraformaldehyde 15 lb 12 oz (0.4778 lb moles). The temperature was raised to 235° F. until the paraformaldehyde dissolved and was reduced to 215° F. until the free formaldehyde assay showed 13.5% in about an hour and a half. Four increments of 12 g each of calcium hydroxide were added at fifteen minute intervals. The free formaldehyde was 2.4% in two hours and 17 lb of n-butyl alcohol were added to the reaction mixture. Water was distilled at atmospheric pressure by azeotropic separation until 4 lb 15 oz were collected. The solvent was vacuum stripped to a resin viscosity of 2040 cps and the liquid resin (47 lb 4 oz) was discharged.

EXAMPLE 13

The experiment of Example 12 was repeated in all essential details except that the calcium hydroxide was added when the free formaldehyde content was 17.7% and the butanol was added when the free formaldehyde content was 4.0%. The viscosity of the product was 1560 cps.

I claim:

1. A phenol-formaldehyde resin prepared by reacting phenol with aqueous paraformaldehyde in a phenol-to-formaldehyde mole ratio in the range of 1.0:0.75 to 1.0:2.0 in the presence of alcohol having 3 to 6 carbon atoms at an initial temperature of about 215° F. and adjusting the pH to within the range of 0.1 to 2.5 for a time sufficient to reduce the free formaldehyde content of the charge to about 10 to 16% by weight of the total charge, cooling the reaction mixture to below about 180° F., adjusting the pH to about 5.0 to 6.5, and continuing the reaction with exotherm to free formaldehyde content of about 1.5 to 9% by weight of the total charge, then charging an additional quantity of an alcohol having 3 to 6 carbon atoms and continuing the reaction while removing water by azeotropic distillation at a temperature up to 265° F., and recovering a resin product containing less than 2% free water and less than 3% free formaldehyde after excess solvent has been removed.

2. The composition of claim 1 in which the pH is adjusted to about 5.0 to 6.5 with lithium hydroxide.

3. The composition of claim 1 in which the pH is adjusted to about 5.0 to 6.5 with sodium hydroxide.

4. The composition of claim 1 in which the pH is adjusted to about 5.0 to 6.5 with potassium hydroxide.

5. A phenol-formaldehyde resin prepared by reacting phenol with aqueous paraformaldehyde in a phenol-to-formaldehyde mole ratio in the range of 1.0:0.75 to 1.0:2.0 in the presence of alcohol having 3 to 6 carbon atoms at an initial temperature of about 215° F. and at a pH in the range of 0.1 to 3.5 for a time sufficient to reduce the free formaldehyde content of the charge to about 10 to 16% by weight of the total charge, cooling the reaction mixture to below about 180° F., adjusting the pH to within 5–6.5 and continuing the reaction with exotherm to free formaldehyde content of about 1.5–9% by weight of the total charge, then charging an additional quantity of an alcohol having 3 to 6 carbon atoms and continuing the reaction while removing water by azeotropic distillation at a temperature up to 265° F., and recovering a resin product containing less than 2% free water and less than 3% free formaldehyde after excess solvent has been removed.

6. The composition of claim 5 in which the alcohol is n-butanol.

7. The composition of claim 6 in which the pH is adjusted with hypophosphorous acid.

8. The composition of claim 6 in which the pH is adjusted to 0.6 to 2.5 with hypophosphorous acid, a 50% mixture of hypophosphorous acid and aspirin or oxalic acid.

9. The composition of claim 6 in which the pH is adjusted to 5–6.5 with barium hydroxide, calcium hydroxide, zinc oxide, lithium hydroxide, sodium hydroxide or potassium hydroxide.

10. The composition of claim 9 in which the pH is adjusted with calcium hydroxide.

11. The composition of claim 9 in which the pH is adjusted with zinc oxide.

12. A resin component adapted for reaction with a polyisocyanate in the presence of a catalyst to provide a binder composition comprising in admixture a. A phenol-formaldehyde resin characterized by:
   (i) A phenol formaldehyde mole ratio in the range of 1.0:0.75 to 1.0:2.0,
   (ii) A substituent $—(CH_2—O)_y—R$ group present at about 12 to 30% of the substituted phenolic nuclear positions,
   (iii) Free phenol in the amount of about 5 to 15% by weight of the resin,
   (iv) Water in the amount of less than 2% by weight of the resin,
   (v) An average of about 2 ½ to 3 ½ phenolic nuclei per resin oligomer, and
   (vi) A hydroxymethyl content of less than about 5 mole percent;

the bridges joining phenolic nuclei of said resin being predominantly ortho-para with at least about 20% of the bridges being para-para, said bridges being of the formula $—CH_2(OCH_2)_x—$ where $x$ is zero in at least 30% of the bridges and $x$ is an integer in the range of 1 to 6 in at least 20% of the bridges, $y$ is an integer in the range of 1 to 6 and R is a hydrocarbon radical of 3 to 6 carbon atoms; and b. A solvent in the amount of about 10% to 40% by weight of the resin solvent admixture, said solvent being of the formula

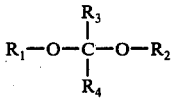

in which $R_1$ and $R_2$ are the same or different hydrocarbon radicals of 3 to 6 carbon atoms and $R_3$ and $R_4$ are the same or different hydrogen, methyl, ethyl or phenyl radicals.

13. The resin component of claim 12 in which $R_3$ and $R_4$ are hydrogen.

14. The resin component in accordance with claim 13 in which R is butyl.

15. The resin component of claim 14 in which $R_1$ and $R_2$ are both butyl.

16. A polyisocyanate component adapted for reaction with a resin component to provide a binder composition comprising in admixture a reactive polyisocyanate and a solvent in the amount of about 10 to 40% by weight of the admixture, said solvent being of the formula

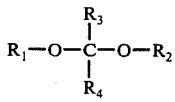

where $R_1$ and $R_2$ are the same or different hydrocarbon radicals of 3 to 6 carbon atoms and $R_3$ and $R_4$ are the same or different hydrogen, methyl, ethyl or phenyl radicals.

17. The composition of claim 16 in which $R_3$ and $R_4$ are hydrogen.

18. The composition of claim 17 in which the polyisocyanate comprises diphenylmethane diisocyanate.

19. The composition of claim 17 in which the polyisocyanate comprises triphenylmethane triisocyanate.

20. The composition of claim 18 in which $R_1$ and $R_2$ are butyl.

21. The composition of claim 19 in which $R_1$ and $R_2$ are butyl.

22. The composition of claim 17 in which the solvent comprises about 23% of the admixture.

23. A binder composition comprising in admixture:

a. A phenol-formaldehyde resin characterized by:
   (i) A phenol-formaldehyde mole ratio in the range of 1.0:0.75 to 1.0:2.0,
   (ii) A substituent $—(CH_2—O)_y—R$ group present at about 12 to 30% of the available phenolic nuclear positions,
   (iii) Free phenol in the amount of about 5 to 15% by weight of the resin,
   (iv) Water in the amount of less than 2% by weight of the resin,
   (v) An average of about 2 ½ to 3 ½ phenolic nuclei per resin oligomer, and
   (vi) A hydroxymethyl content of less than about 5 mole percent;

the bridges joining phenolic nuclei of said resin being predominantly ortho-para with at least about 20% of the bridges being para-para, said bridges being of the formula $—CH_2(OCH_2)_x—$ where $x$ is zero in at least 30% of the bridges and $x$ is an integer in the range of 1 to 6 in at least 20% of the bridges, $y$ is an integer in the range of 1 to 6 and R is a hydrocarbon radical of 3 to 6 carbon atoms;

b. a reactive liquid polyisocyanate, and;

c. a solvent in the amount of about 10 to 40% by weight of the resin solvent admixture, said solvent being of the formula

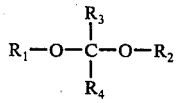

in which $R_1$ and $R_2$ are the same or different hydrocarbon radicals of 3 to 6 carbon atoms and $R_3$ and $R_4$ are the same or different hydrogen, methyl, ethyl or phenyl radicals.

24. The composition of claim 23 in which $R_3$ and $R_4$ are hydrogen.

25. The composition of claim 24 in which R is butyl.

26. The composition of claim 25 in which $R_1$ and $R_2$ are both butyl.

27. The composition of claim 26 in which the solvent is present in the amount of about 23% by weight of the resin.

* * * * *